US007878354B2

(12) United States Patent
Chae

(10) Patent No.: US 7,878,354 B2
(45) Date of Patent: Feb. 1, 2011

(54) ONE TOUCH-TYPE STOPPER AND A CONTAINER HAVING THE SAME

(76) Inventor: Dong-Seuk Chae, 27-28 Gwangmyeong 3-Dong, Gwangmyeong-Si, Gyeonggi-Do 423-013 (KR)

( * ) Notice: Subject to any disclaimer, the term of this patent is extended or adjusted under 35 U.S.C. 154(b) by 984 days.

(21) Appl. No.: 10/565,257

(22) PCT Filed: Jul. 23, 2004

(86) PCT No.: PCT/KR2004/001850

§ 371 (c)(1),
(2), (4) Date: Jan. 19, 2006

(87) PCT Pub. No.: WO2005/009852

PCT Pub. Date: Feb. 3, 2005

(65) Prior Publication Data

US 2006/0186080 A1 Aug. 24, 2006

(30) Foreign Application Priority Data

Jul. 25, 2003 (KR) ..... 10-2003-0051375
Mar. 19, 2004 (KR) ..... 10-2004-0018808

(51) Int. Cl.

| | |
|---|---|
| ***B65D 45/32*** | (2006.01) |
| ***B65D 39/00*** | (2006.01) |
| ***B65D 41/00*** | (2006.01) |
| ***B65D 43/00*** | (2006.01) |
| ***B65D 43/08*** | (2006.01) |
| ***B65D 45/16*** | (2006.01) |

(52) U.S. Cl. ..... 215/301; 215/272; 215/317; 215/298; 215/305; 220/796; 220/326; 220/324

(58) Field of Classification Search ..... 215/272, 215/317, 293, 359, 298, 296, 301, 305, 326; 220/796, 801, 802
See application file for complete search history.

(56) References Cited

U.S. PATENT DOCUMENTS

| | | | | | |
|---|---|---|---|---|---|
| 3,858,742 | A | * | 1/1975 | Grussen | 215/253 |
| 4,089,571 | A | * | 5/1978 | Landy | 312/1 |
| 4,500,006 | A | * | 2/1985 | Lafortune et al. | 215/224 |
| 5,147,059 | A | * | 9/1992 | Olsen et al. | 220/281 |
| 5,251,770 | A | * | 10/1993 | Bartley et al. | 215/270 |
| 5,833,088 | A | * | 11/1998 | Kladders et al. | 215/248 |

FOREIGN PATENT DOCUMENTS

| | | |
|---|---|---|
| JP | 08-217104 | 8/1996 |
| JP | 08-295361 | 11/1996 |
| JP | 09-286453 | 11/1997 |

* cited by examiner

*Primary Examiner*—Anthony Stashick
*Assistant Examiner*—Andrew T Kirsch
(74) *Attorney, Agent, or Firm*—IPLA P.A.; James E. Bame

(57) ABSTRACT

A one touch-type stopper operable with one hand is provided. The one touch-type container stopper comprises a hermetically sealing part which has, at a lower end thereof, first supporting protrusions formed to protrude inwardly such that they are elastically supported along an outer peripheral surface of a mouth of the container and is fitted around the mouth to seal the container: and a cover part which has a hinge part formed integrally with and extending from the first supporting protrusions and then bent, and second supporting protrusions at a lower end thereof to protrude inwardly therefrom and is positioned outside of the sealing part. The second supporting protrusions are connected to one another through a band member.

9 Claims, 13 Drawing Sheets

ONE TOUCH-TYPE STOPPER AND A CONTAINER HAVING THE SAME

TECHNICAL FIELD

The present invention relates to a one touch-type stopper and a container having the stopper, wherein opening and/or sealing operations for a container can be easily performed with one hand to achieve the convenience of use.

BACKGROUND ART

Conventional containers for storing beverages, powder and other contents therein are provided with stoppers. Such stoppers are required to provide a variety of functions according to the uses or stored contents of storage containers.

For example, in case of a carbonated beverage container, the pressure in the container should be maintained at pressure higher than atmospheric pressure. Thus, it is important to keep hermetical sealing of a stopper during distribution of the container. In case of a large-capacity container, it is preferred that after the container has been opened, a stopper close and seal the container again to store remaining contents therein.

Further, in case of alcoholic liquors or medicines, it is preferred that after first opening of a stopper, the opening thereof can be checked.

As described above, conventional stoppers are manufactured variously and then used according to stored contents and functions of containers.

DISCLOSURE OF INVENTION

An object of the present invention is to provide a reclosable, one touch-type stopper and a container having the stopper, wherein contents can be stored at pressure higher than atmospheric pressure and the container can be closed again by manipulating the stopper with one hand in a one touch manner even when contents remain in the container.

Another object of the present invention is to provide a reclosable, one touch-type stopper and a container having the stopper, wherein after first opening of the stopper, it can be easily checked whether the stopper has been opened.

A one touch-type container stopper of the present invention comprises a hermetically sealing part which has, at a lower end thereof, a plurality of first supporting protrusions formed to protrude inwardly such that they are elastically supported along an outer peripheral surface of a mouth of the container and is fitted around the mouth to seal the container; and a cover part which has a hinge part formed integrally with and extending from the first supporting protrusions and then bent, and a plurality of second supporting protrusions at a lower end thereof to protrude inwardly therefrom and is positioned outside of the sealing part. The second supporting protrusions are connected to one another through a band member.

A container having a one touch-type stopper according to the present invention comprises a body portion of the container having a first catching projection at an upper end of a mouth thereof, and a second catching projection that is formed below the first catching projection and has an outer diameter larger than that of the first catching projection; and a stopper having a hermetically sealing part fitted around the mouth to seal the container, and a cover part positioned outside of the sealing part. The sealing part is provided with a plurality of first supporting protrusions at a lower end thereof to protrude inwardly such that they are caught and elastically supported by the first catching projection. The cover part is provided with a hinge part formed integrally with and extending from the first supporting protrusions and then bent, and a plurality of second supporting protrusions at a lower end thereof to protrude inwardly therefrom. The second supporting protrusions are connected to one another through a band member.

BEST MODE FOR CARRYING OUT THE INVENTION

Figure 1:
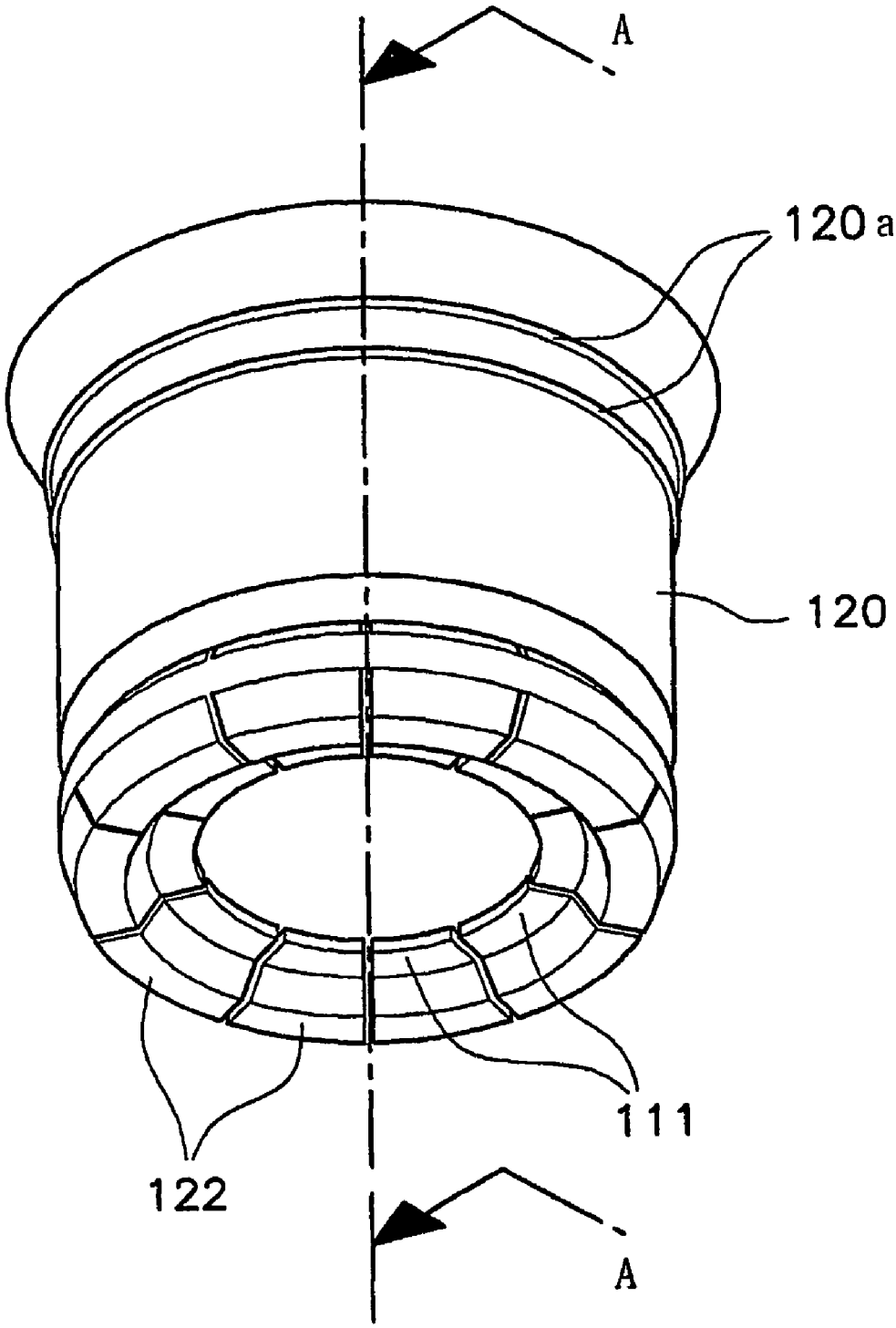
FIG. 1 is a bottom perspective view of a container stopper according to a first embodiment of the present invention.
Figure 2:
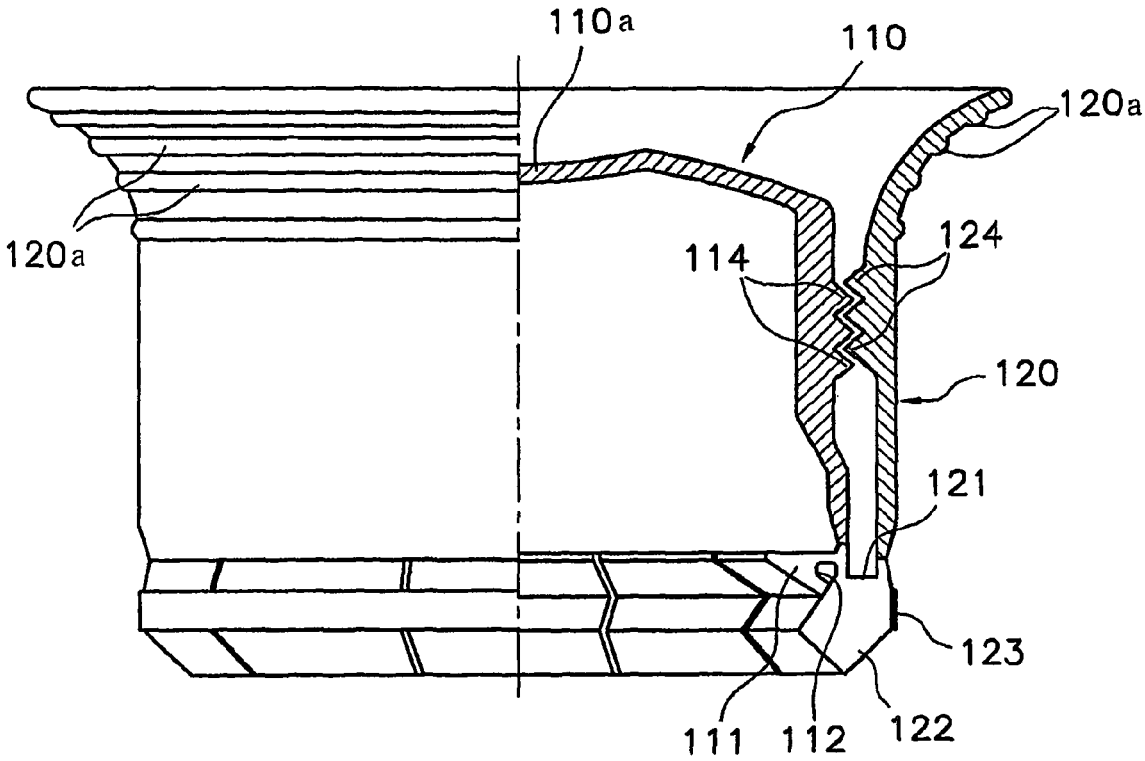
FIG. 2 is a partial sectional view taken along line A-A in FIG. 1.
Figure 3:
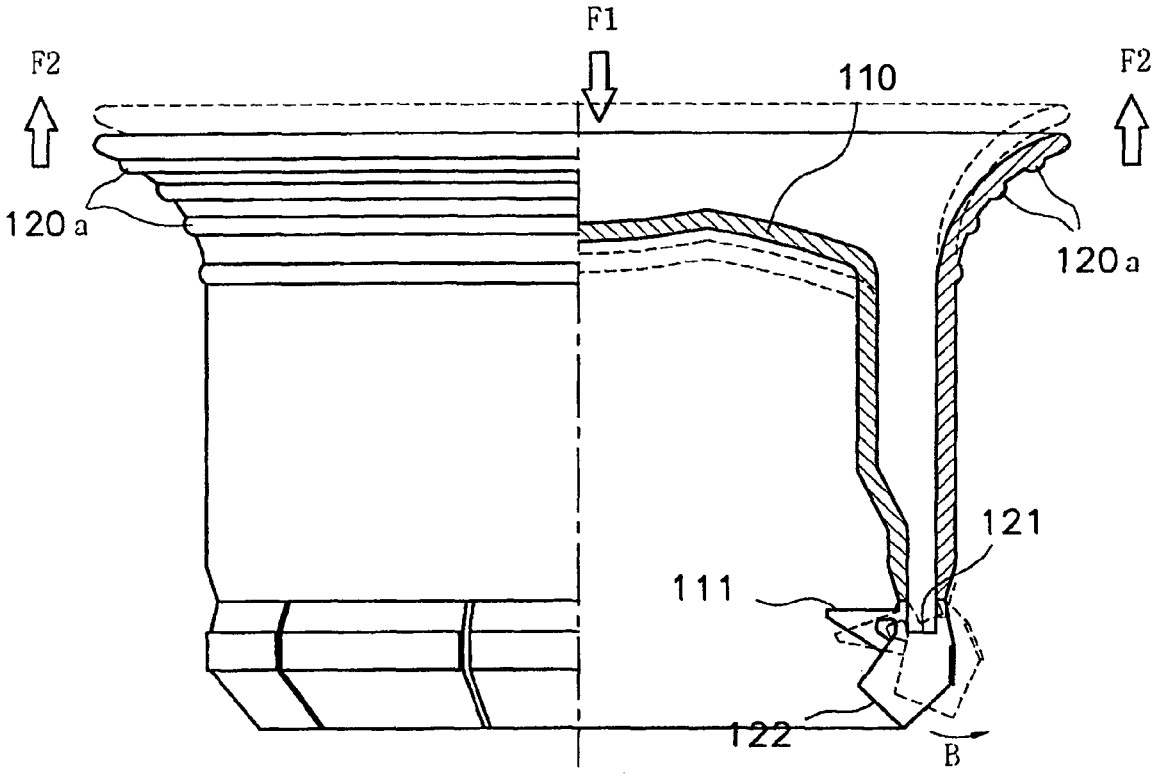
FIG. 3 is a sectional view showing an operating state of the container stopper according to the first embodiment of the present invention.
Figure 4:
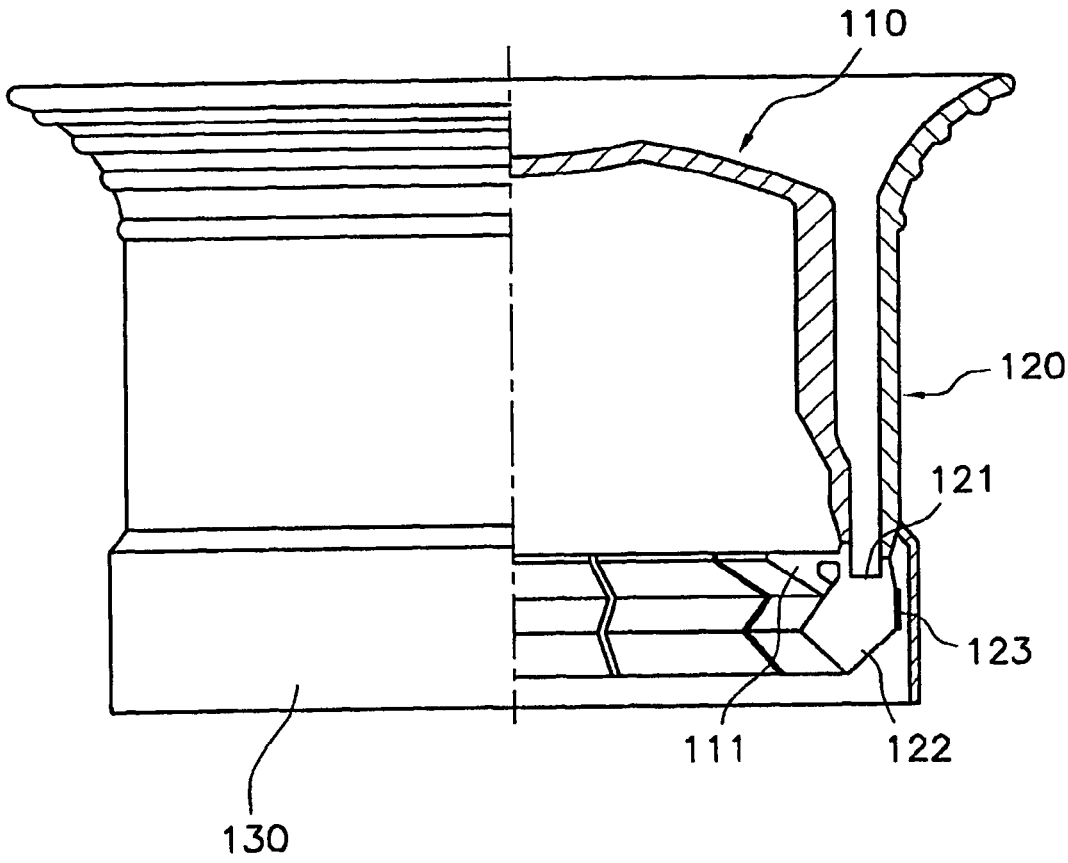
FIG. 4 is a view of the container stopper having a cover part with a cover member according to the present invention.
Figure 5:
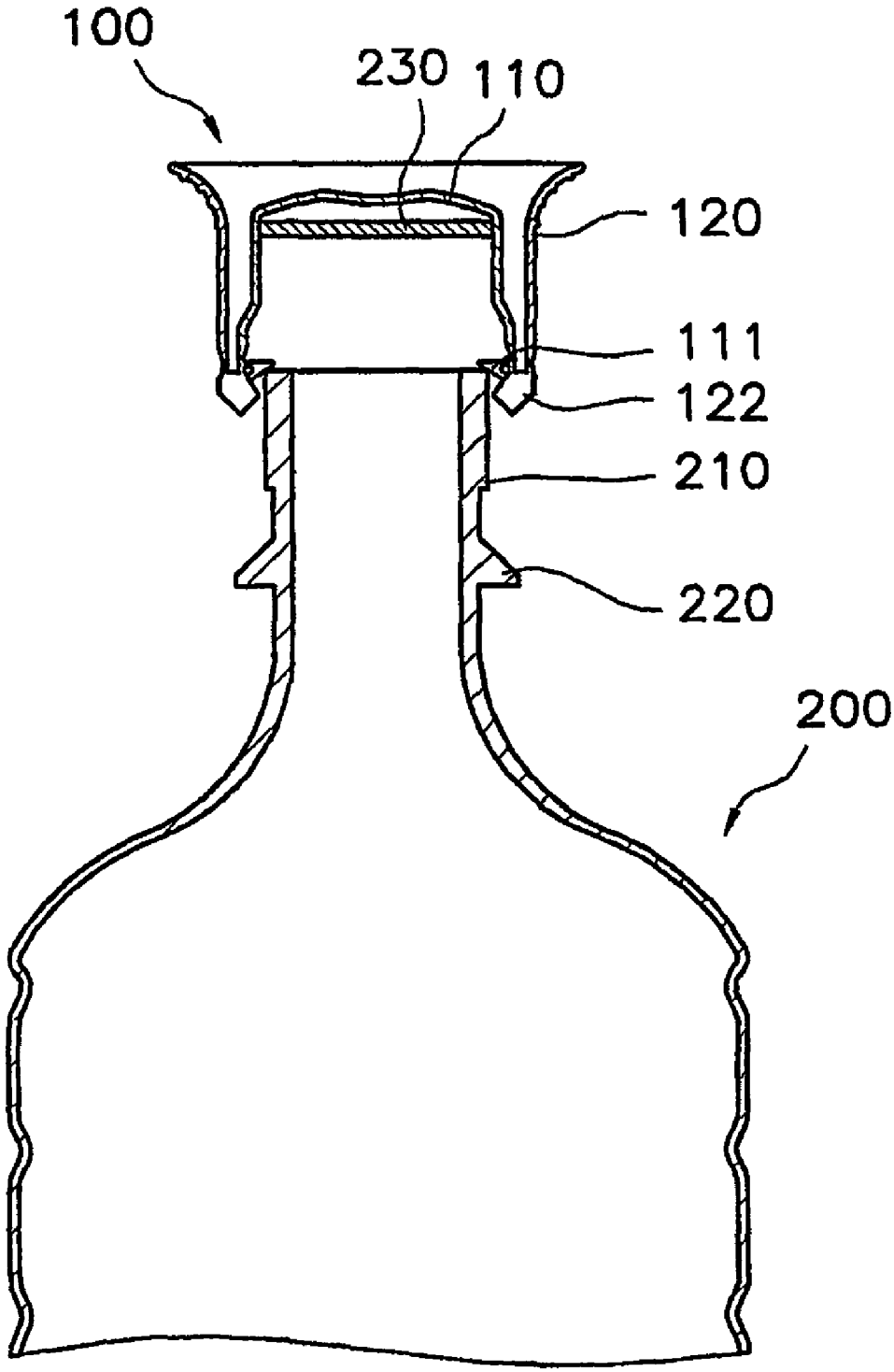
FIGS. 5 and 6 are views illustrating first sealing engagement of the stopper with a container in accordance with the present invention.
Figure 6:
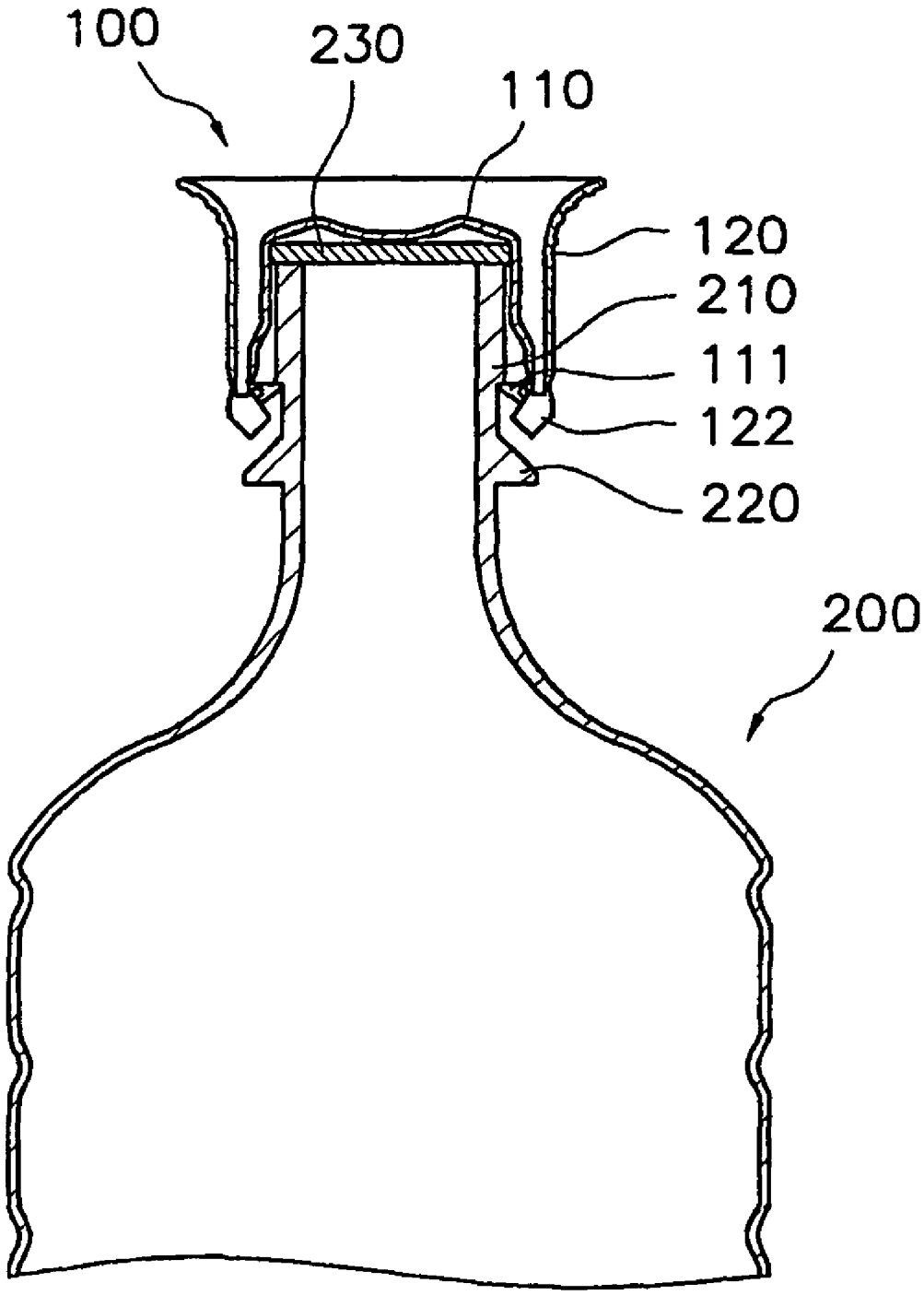
Figure 7:
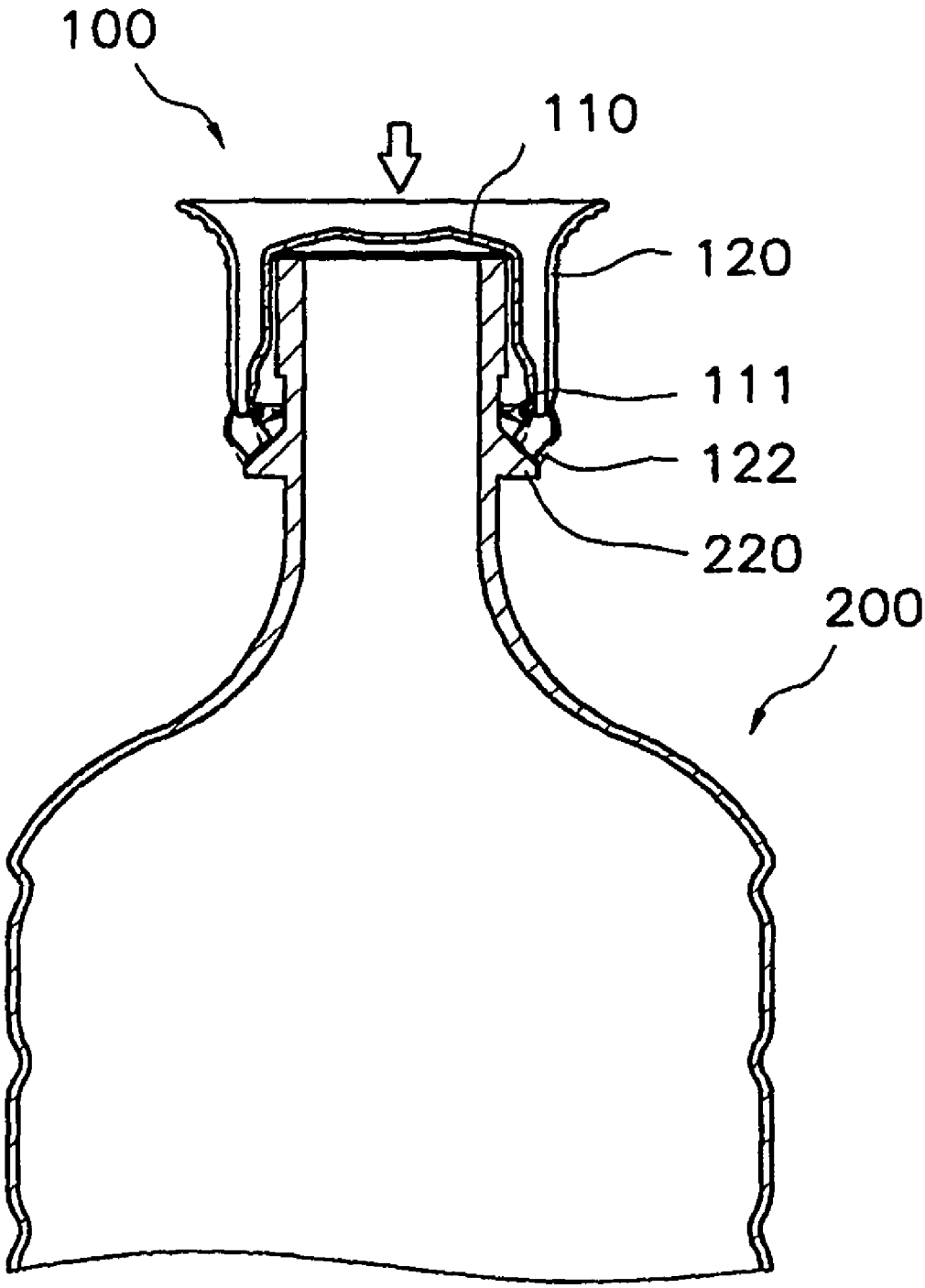
FIGS. 7 to 9 are views illustrating removal of the stopper from the container in accordance with the present invention.
Figure 8:
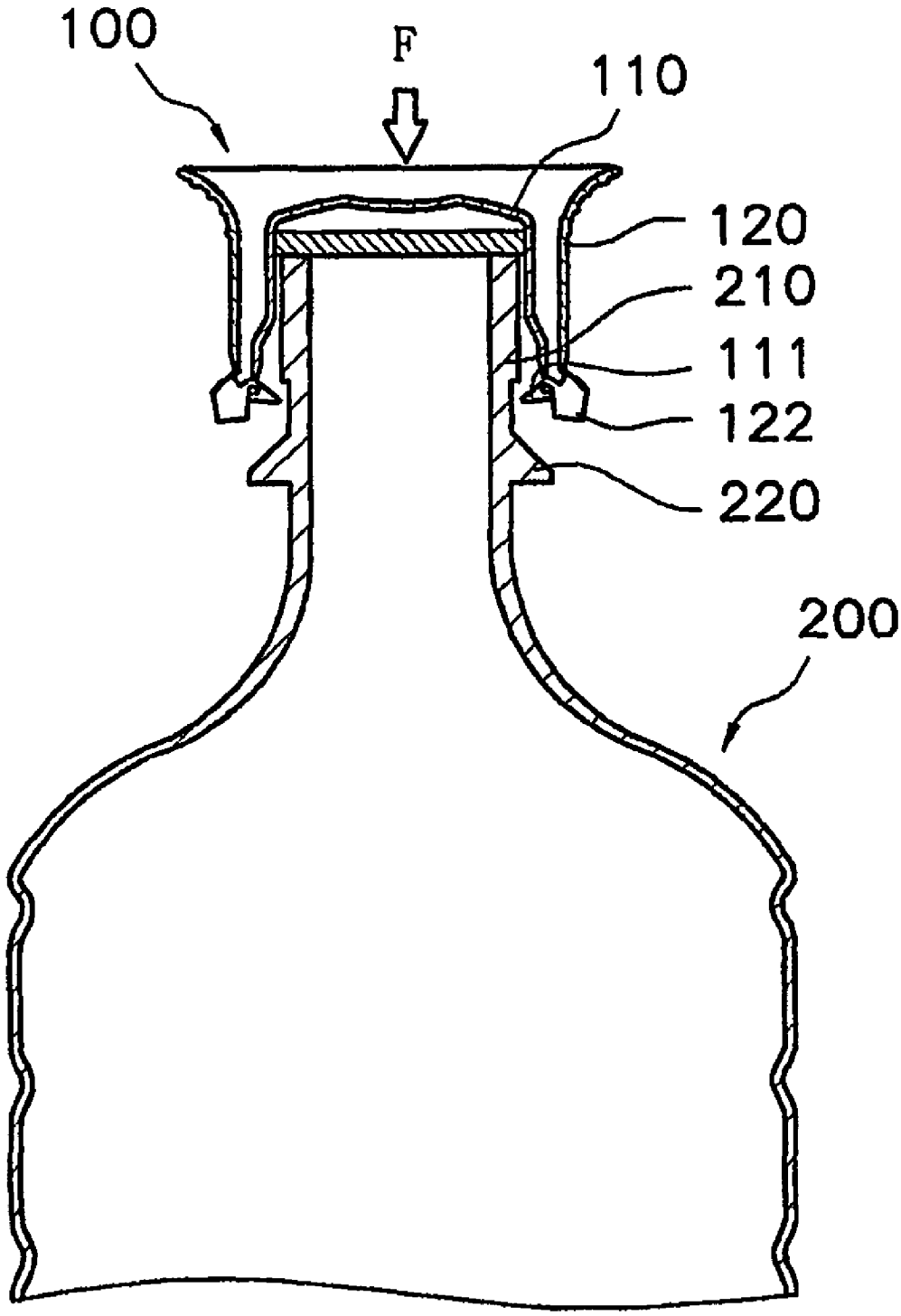
Figure 9:
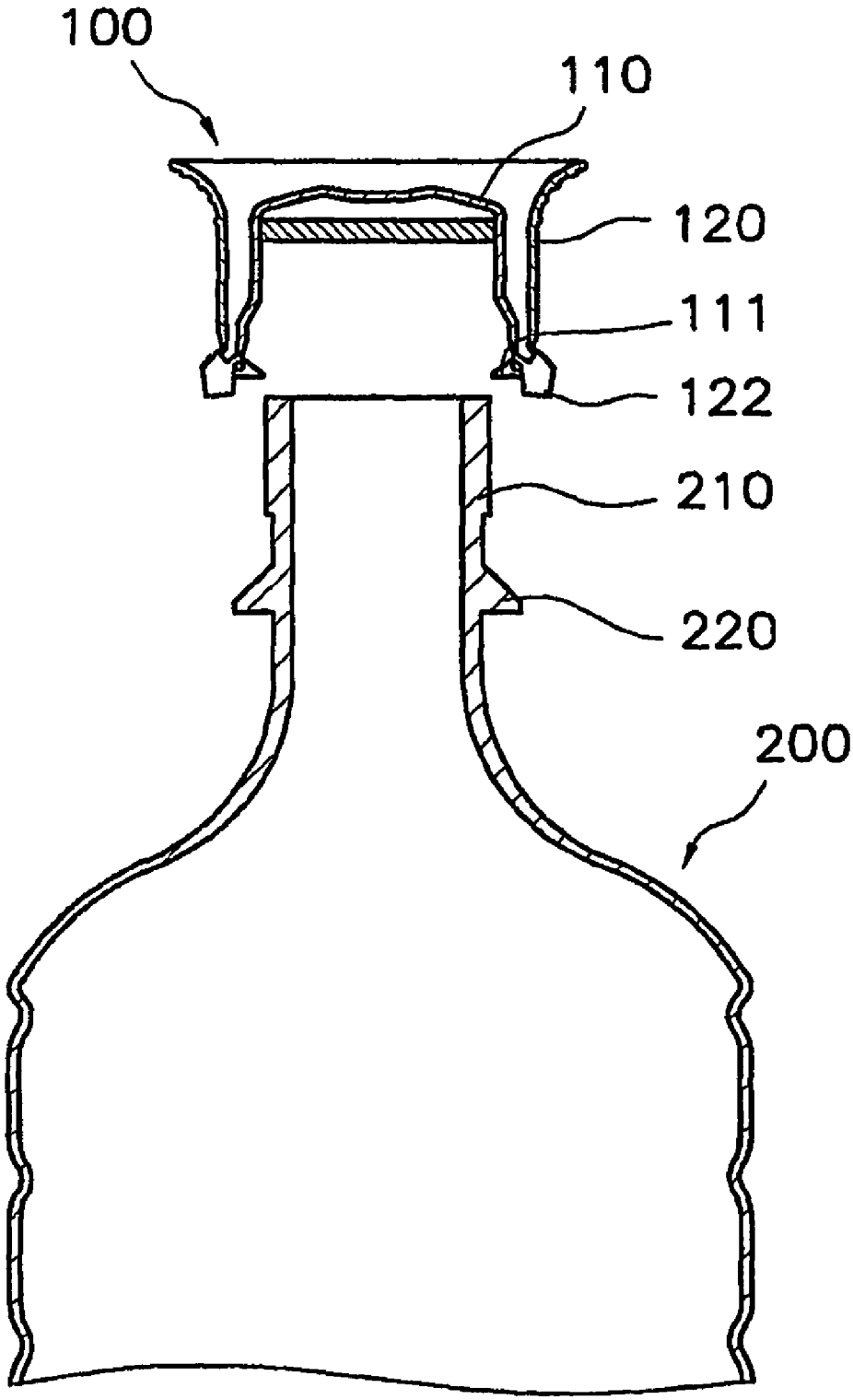

FIGS. 1 to 9 show a container and a stopper according to a first embodiment of the present invention. FIG. 1 is a bottom perspective view of the container stopper according to the first embodiment of the present invention, FIG. 2 is a partial sectional view taken along line A-A in FIG. 1, FIG. 3 is a sectional view showing an operating state of the container stopper according to the first embodiment of the present invention, FIG. 4 is a view of the container stopper having a cover part with a cover member according to the present invention, FIGS. 5 and 6 are views illustrating first sealing engagement of the stopper with a container in accordance with the present invention, and FIGS. 7 to 9 are views illustrating removal of the stopper from the container in accordance with the present invention.

First Embodiment

Hereinafter, the first embodiment of the present invention will be described in detail with reference to the accompanying drawings.

A one touch-type container stopper of the present invention comprises a hermetically sealing part 110 fitted over an opening of a mouth of a container to seal the container; and a cover part 120 connected through hinge part 121 to a lower end of the hermetically sealing part 110. An upper portion of the cover part 120 is relatively wide whereas a lower portion thereof is relatively narrow in width.

The hermetically sealing part 110 has a plurality of first supporting protrusions 111 at the lower end thereof. The first supporting protrusions are formed to protrude inwardly such that they are elastically supported along an outer peripheral surface of the mouth of the container.

As shown in FIG. 2, it is preferred that a top surface of each of the first supporting protrusions 111 be substantially flat, and a bottom surface thereof be formed to have an inclination at a predetermined angle. Therefore, upon engagement thereof with a body portion of the container, the container stopper can be easily inserted along the inclination of the bottom surface. On the contrary, upon disengagement of the container stopper from the body portion, the top surfaces of the first supporting protrusions 111 are caught by the body portion of the container so that the container stopper cannot easily escape from the container.

Each of the first supporting protrusions 111 is laterally formed with a hollow portion 112 of which a lower end is cut out.

An inwardly indented, pressing depression 110*a* is formed at the center of an upper end of the hermetically sealing part 110 to facilitate the pressing of the sealing part 110.

The cover part 120 has a radially outwardly flared, upper end to facilitate grasp thereof and is connected to the lower end of the hermetically sealing part 110 through the hinge part 121.

A lower end of the cover part 120 is provided with second supporting protrusions 122 which are formed integrally with the first supporting protrusions 111 to protrude diametrically inwardly. The hinge part 121 that extends from the lower end of the hermetically part 110 and is then bent is located on upper ends of the second supporting protrusions 122 positioned between the hermetically sealing part 110 and the cover part 120. When an external force is applied to the hinge part 121, the first and second supporting protrusions 111 and 122 are elastically deformed and pivoted on the hinge part 121. Opening and closing operations of the stopper 100 by means of actions of the hinge part 121 will be specifically described again later.

A plurality of ridges 120*a* are formed to protrude from an outer peripheral surface of the upper end of the cover part 120, thereby preventing a hand from slipping on the cover part 120 when a user grasps the cover part 120 and presses down the hermetically sealing part 110.

Meanwhile, the second supporting protrusions 122 are connected to one another through a band member 123 which is preferably constructed to be broken when the second supporting protrusions 122 are expanded due to an external force and thus tension larger than a predetermined threshold is exerted on the band member 123.

Preferably, the cover part 120 is formed to have a height larger than that of the hermetically sealing part 110 in order to minimize exposure of the hermetically sealing part 110 outside of the cover part 120. Thus, it is possible to prevent the container stopper from being opened because the hermetically sealing part 110 is pressed down during handling of the container.

Preferably, a friction member is further provided between the hermetically sealing part 110 and the cover part 120 such that the hermetically sealing part 110 and the cover part 120 are operated only when an external force larger than a static frictional force is exerted thereon, whereby the stopper can be securely fixed to the container.

As a specific example of the friction member, as shown in FIG. 2, an outer surface of the hermetically sealing part 110 is provided with first teeth 114 in the form of sawteeth. An inner surface of the cover part 120 is provided with second teeth 124 that engage with the first teeth 114. When the hermetically sealing part 110 and the cover part 120 are operated vertically, the first and second teeth 114 and 124 are offset from each other while being elastically deformed.

Further, as another example of the friction member, a recess is formed between the hermetically sealing part and the cover part. A rubber ring is fitted into the recess to restrict the operations of the hermetically sealing part and the cover part by producing a frictional force in an up and down direction while being elastically deformed between the hermetically sealing part and the cover part when they are operated in the up and down direction.

FIG. 3 is a sectional view showing an operating state of the container stopper according to the first embodiment of the present invention. When the upper end of the hermetically sealing part 110 is pressed down (in a direction designated by an arrow F1) and the cover part is simultaneously pulled (in a direction designated by arrows F2) in a state where the ridges 120*a* formed on the upper end of the cover part 120 are grasped, the lower ends of the hermetically sealing part 110 and the cover part 120 connected through the hinge part 121 are elastically deformed so that the first and second supporting protrusions 111 and 122 are flared outwardly while pivoting outwardly (in a direction designated by an arrow B). At this time, the band member 123 that has connected the second supporting protrusions into a single unit is broken.

Meanwhile, FIG. 6 is a view showing a state where the container stopper and the container according to the present invention are engaged with each other. A first catching projection 210 is formed at an upper end of the mouth of the body portion 200 of the container, and a second catching projection 220 having an outer diameter larger than that of the first catching projection 210 is formed below the first catching projection 210.

The first supporting protrusions 111 of the stopper 100 are caught and elastically supported by the first catching projection 210, and the second catching projection 220 is positioned to face the second supporting protrusions 122 with a certain gap therebetween.

Preferably, a hermetically sealing member 230 is further provided to prevent leakage of contents while being fitted into and compressed between the mouth of the body portion 200 of the container and the hermetically sealing part 110 to maintain hermetical sealing.

Meanwhile, as shown in FIG. 4, the lower end of the cover part 120 is further provided with a cover member 130 for surrounding the second supporting protrusions 122 so that a finger can be prevented from being pinched between the second supporting protrusions 122 upon opening or closing manipulation of the stopper. It is preferred that the inner diameter of the cover member 130 be large to such an extent that the cover member does not interfere with the second supporting protrusions 122 upon opening or closing manipulation of the stopper.

The assembly and use of the container stopper of the present invention with the container will be described below.

FIG. 5 is a view showing a process of initially sealing the container in a state where contents are contained in the body portion 200 of the container. When the container stopper 100 is being fitted around the mouth of the body portion 200 of the container in the state where the contents are contained in the body portion 200, the first supporting protrusions 111 are elastically deformed and fitted along the outer peripheral surface of the mouth of the container.

FIG. 6 is a view showing a state where the container stopper 100 has been completely engaged with the mouth of the body portion 200 of the container. The first supporting protrusions 111 are caught by and secured on the first catching projection 210 of the body portion 200 of the container, so that the stopper 100 is firmly fixed to the body portion 200 of the container. Thus, the contents are prevented from leaking by means of the hermetically sealing member 230 compressed between the mouth of the main body and the hermetically sealing part 110.

Meanwhile, since the first supporting protrusions 111 are not flared outwardly in a state where the second supporting protrusions 122 are connected to one another through the band member, the stopper cannot be opened in a state where the band member is not broken. Therefore, the opening of the stopper can be easily confirmed after first opening thereof by checking whether the second supporting protrusions 122 are connected through the band member.

That is, since the second supporting protrusions 122 are located below the first supporting protrusions 111 and connected to one another through the band member, the first supporting protrusions 111 are not flared outwardly. To initially open the stopper, the band member for connecting the second supporting protrusions 122 to one another should be first broken.

Next, a method of opening the container by removing the stopper therefrom will be described.

As shown in FIG. 7, the center of the top of the container stopper 100 is strongly pressed down to break the band member that has connected the second supporting protrusions 122 to one another. Then, the second supporting protrusions 122 are brought into contact with and pressed against the second catching projection 220 of the body portion 200 of the container. Accordingly, the band member that has connected the second supporting protrusions 122 to one another is broken and thus the second supporting protrusions 122 are flared outwardly.

When the stopper 100 is released after the band member is broken, the elastically deformed stopper 100 returns to the state shown in FIG. 6 and the first supporting protrusions 111 are caught and elastically supported by the first catching projection 210.

FIG. 8 is a view showing a process of opening the stopper. When the center of the upper end of the hermetically sealing part 110 is pressed with a thumb (in a direction designated by an arrow F) while the ridges 120*a* formed at the upper end of the cover part 120 are pulled with an index finger and a middle finger, the lower ends of the hermetically sealing part 110 and the cover part 120 are elastically deformed and the first and second supporting protrusions 111 and 122 are flared outwardly.

The stopper 100 is grasped and then pulled out from the mouth of the body portion 120 of the container in the state where the first and second supporting protrusions 111 and 122 are flared outwardly, thereby opening the container.

FIG. 9 is a view showing a state where the stopper 100 has been pulled out from the body portion 200 of the container.

When the container is intended to be sealed again, the stopper is fitted around the mouth of the body portion of the container and the cover part 120 is then pushed down until the first supporting protrusions 111 are caught by the first catching projection 210. Accordingly, the container is sealed again.

Figure 10:
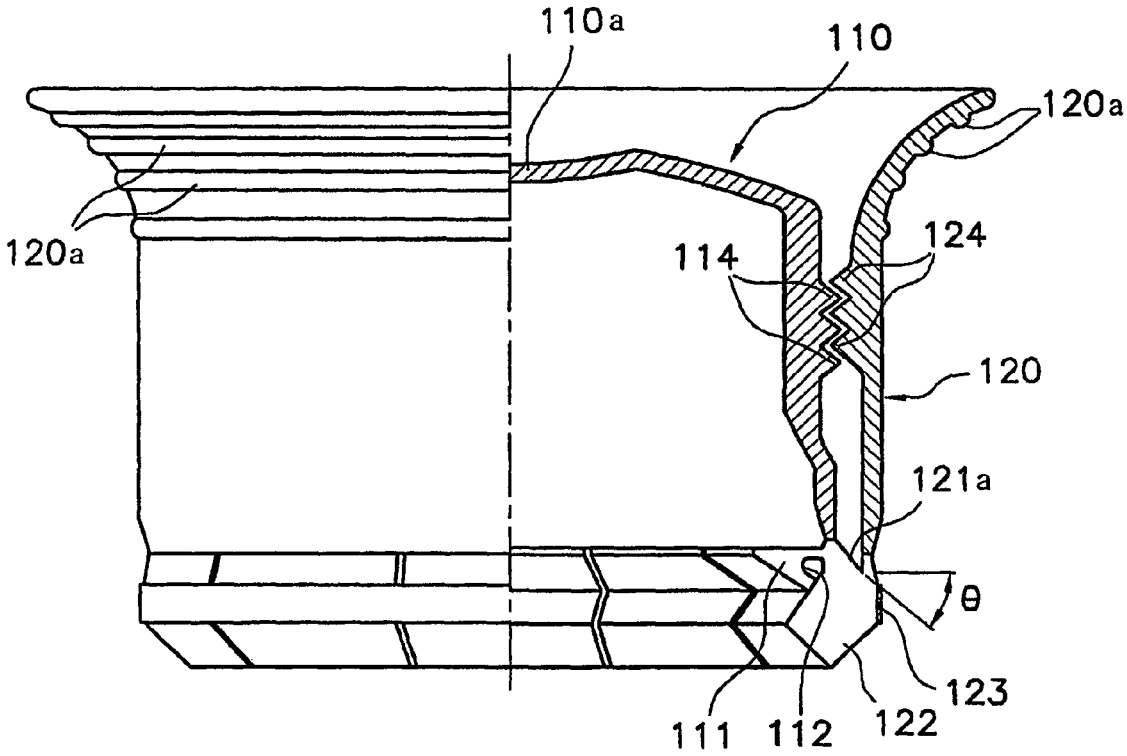
FIG. 10 is a sectional view of a container stopper according to a second embodiment of the present invention.
Figure 11:
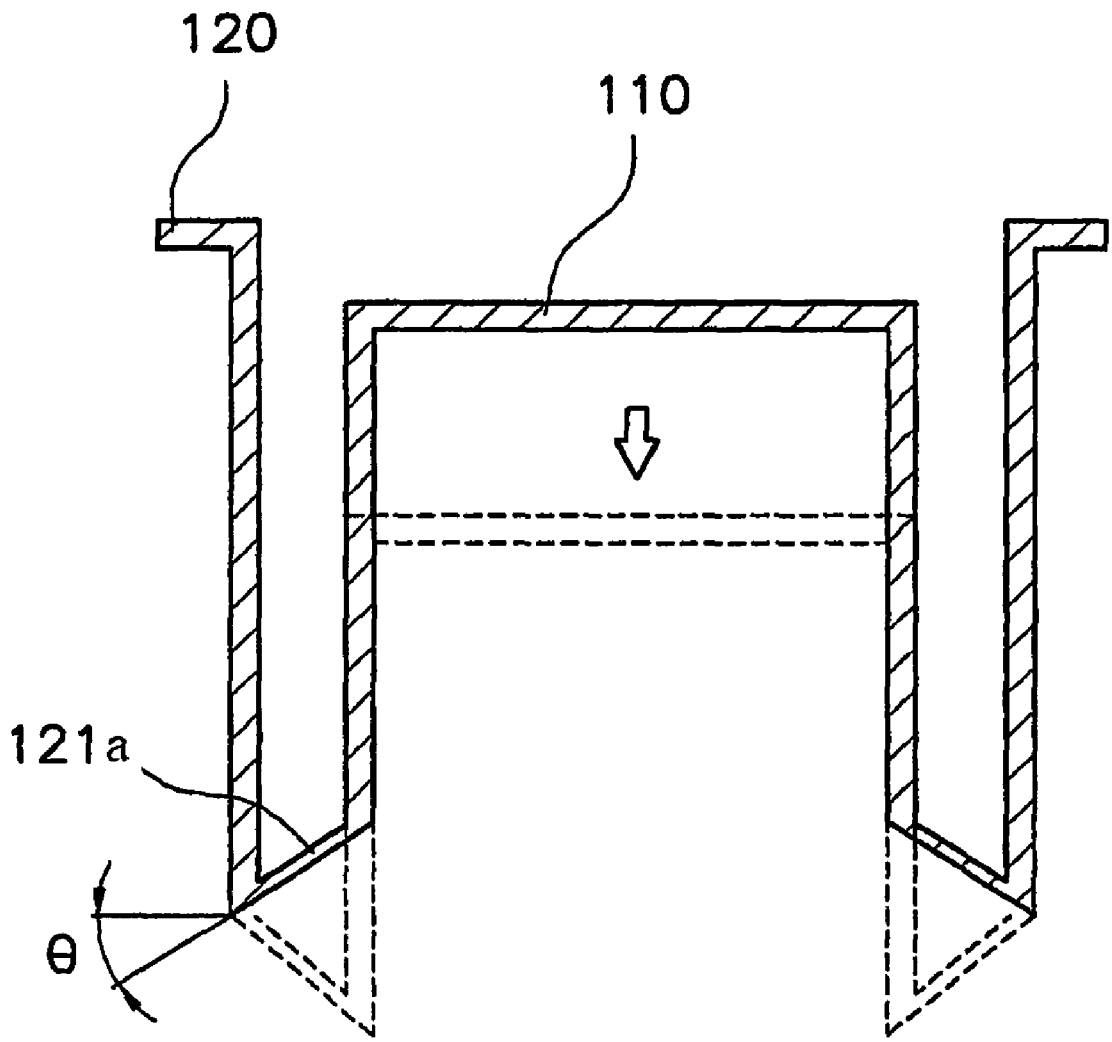
FIG. 11 is a diagram schematically showing the operation of the container stopper according to the second embodiment of the present invention.

FIGS. 10 and 11 are views showing a container stopper according to a second embodiment of the present invention. FIG. 10 is a sectional view of the container stopper according to the second embodiment of the present invention, and FIG. 11 is a diagram schematically showing the operation of the container stopper according to the second embodiment of the present invention.

Hereinafter, the second embodiment of the present invention will be described with reference to the accompanying drawings.

Second Embodiment

Referring to FIG. 10, the container stopper according to the second embodiment of the present invention is constructed in the same manner as the container stopper of the first embodiment except that a hinge part 121*a* has a predetermined inclination of angle e such that the hermetically sealing part 110 side is at a level higher than that of the cover part 120 side.

Preferably, the lower ends of the hermetically sealing part 110 and the cover part 120 connected to the hinge part 121*a* are formed to be thin in thickness, thereby facilitating the bending thereof In the container stopper according to the second embodiment of the present invention, since the hinge part 121*a* is constructed to have the predetermined inclination such that the hermetically sealing part 110 side is at a level higher than that of the cover part 120 side, the first supporting protrusions 111 can be maintained in the flared state by means of a single push operation for the hermetically sealing part 110.

That is, since the hinge part of the stopper of the first embodiment defines a horizontal plane, the stopper should be continuously pressed such that the first supporting protrusions can be maintained in the outwardly flared state while the stopper is opened or seals the container again. On the contrary, the second embodiment of the present invention is characterized in that the first supporting protrusions 111 can be maintained in the flared state by means of a single push operation for the hermetically sealing part 110.

Specifically, FIG. 11 is a diagram schematically showing the operation of the container stopper according to the second embodiment of the present invention, wherein only the shapes of the hermetically sealing part 110, the hinge part 121 a and the cover part 120 of the stopper shown in FIG. 10 are schematically shown.

When the hermetically sealing part 110 is strongly pressed in the state where the cover part 120 is grasped in order to open the stopper, the sealing part 110 moves downward and the direction of the inclination of the hinge part 121*a* is reversed due to the bending of the hinge part 121*a* while a high compression stress is exerted thereon in a horizontal state.

That is, once the hinge part 121*a* is bent so that the direction of the inclination of the hinge part is reversed as indicated by dotted lines in FIG. 11, a compression stress is no longer exerted on the hinge part 121*a*. Therefore, the hinge part 121*a* is maintained in the reversely bent state, and the first and second supporting protrusions are maintained in the outwardly flared state.

On the contrary, when the cover part is pressed after the sealing part is fitted around the mouth of the container, the hinge part is bent back and the direction of the inclination thereof returns to the original state. Then, the first supporting protrusions are caught by the first catching projection of the body portion of the container so that the stopper is fixed to the mouth of the container.

In the second embodiment of the present invention, the magnitude of a force for operating the stopper can be differently set by changing an operating distance of the hinge part according to the contents of the container.

That is, the magnitude of the force for operating the stopper can be appropriately set by properly configuring a height difference between the lower ends of the sealing part and the cover part which defines the inclination of the hinge part.

In the stopper of the present invention constructed as above, the degree of sealing of the container can be controlled by properly setting the length of the hinge part resulting from a gap between the sealing part and the cover part, the length of the first supporting protrusions engaged with the body portion of the container, and the like.

Third Embodiment

Hereinafter, a third embodiment of the present invention will be described. For reference, a description thereof overlapping with that of the first or second embodiment will be omitted, and only differences therebetween will be mainly described.

Figure 12:
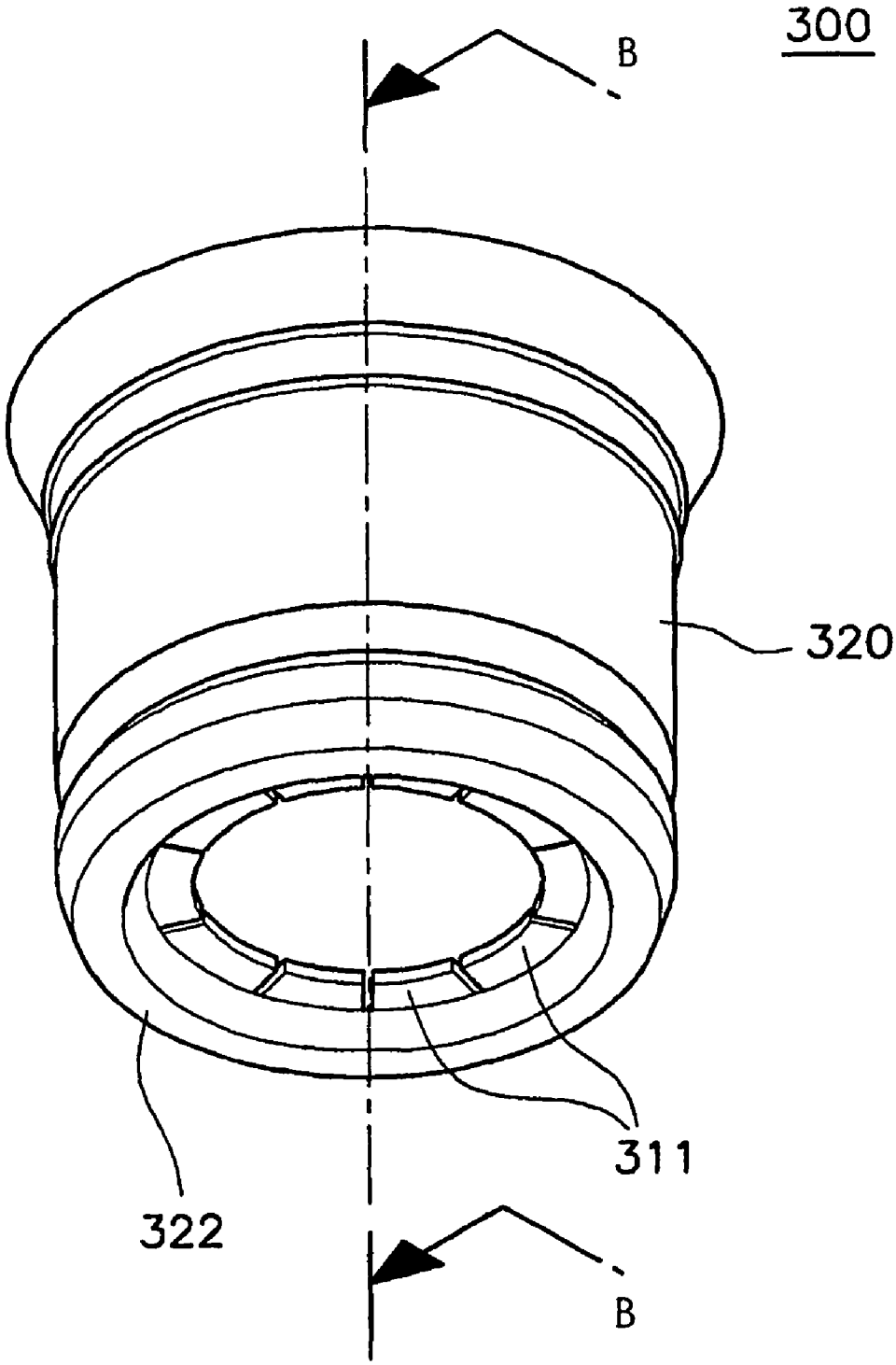
FIG. 12 is a bottom perspective view of a container stopper according to a third embodiment of the present invention.
Figure 13:
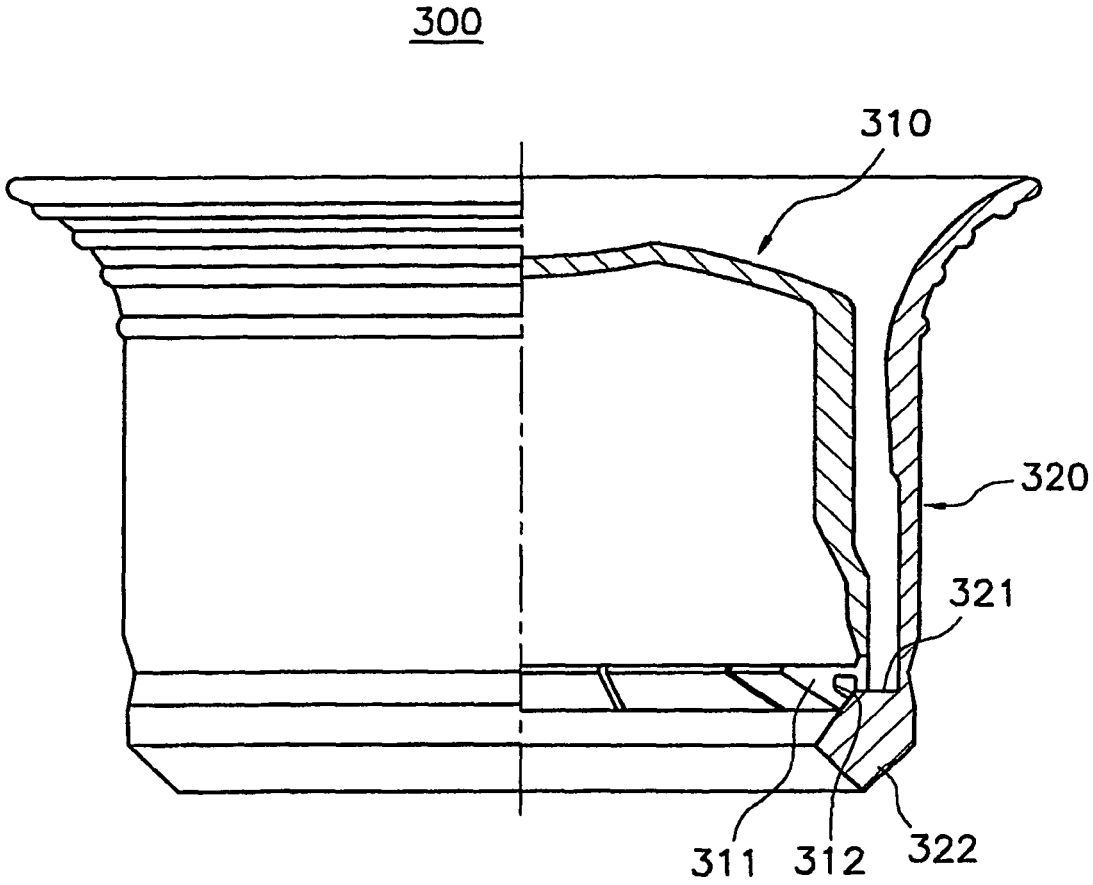
FIG. 13 is a partial sectional view taken along line B-B in FIG. 12.

Referring to FIGS. 12 and 13, a container stopper 300 according to the third embodiment of the present invention is provided, at a lower end thereof, with a plurality of first supporting protrusions 311 which protrude inwardly to be elastically supported along an outer peripheral surface of a mouth of a container. The stopper comprises a hermetically sealing part 310 fitted around the mouth of the container to seal the container, a hinge part 321 formed integrally with and extending from the first supporting protrusions 311 and then bent, and a cover part 320 having a second supporting protrusion 322 at a lower end thereof to protrude inwardly therefrom and positioned outside of the sealing part 310.

In the third embodiment of the present invention, even though the second supporting protrusion 322 is formed integrally contrary to the first or second embodiment, the stopper 300 can be opened in a one-touch manner.

That is, since the second supporting protrusion 322 is made of an elastic material such that it can be elastically deformed radially, the hinge part 321 is elastically deformed when the sealing part 310 is pressed down as described in the first embodiment, and the second supporting protrusion 322 is simultaneously flared outwardly. Thus, the stopper 300 can be opened through the same operation as the first embodiment.

Further, it is preferred that a force required for operating the stopper 300 be appropriately set by properly determining the thickness of the second supporting protrusions 322. For example, if the thickness of the second supporting protrusion 322 is excessively large, a high stress is exerted on the second supporting protrusion 322. Thus, the second supporting protrusion 322 cannot be easily elastically deformed radially. Accordingly, the opening or closing of the container cannot be performed.

Meanwhile, the hinge part may be constructed to have an inclination such that the sealing part side is at a level higher than that of the cover side, as described in the second embodiment. Thus, when the sealing part 310 is pressed down with an operation force larger than a predetermined threshold, the first and second supporting protrusions 311 and 322 are flared so that the stopper can be maintained in the opened state.

The one touch-type stopper and the container having the stopper according to the present invention described above have an excellent sealing effect in that contents can be stored at pressure less than or greater than atmospheric pressure.

Moreover, according to the one touch-type stopper and the container having the stopper according to the present invention, there are the following advantages. After first opening of the stopper, it can be checked whether the stopper has been opened. In addition, even when contents remain in the container, the container can be easily sealed again. It is also possible to prevent the container from being opened due to carelessness during the handling of the container.

The invention claimed is:

1. A one touch-type container stopper, comprising:

a hermetically sealing holding part having a hermetically sealing upper end and a plurality of first supporting protrusions at a lower end thereof, the first supporting protrusions being formed to protrude inwardly such that they are elastically supported along an outer peripheral surface of a mouth of the container such that the hermetically sealing upper end of the hermetically sealing holding part is fitted hermetically due to the elastic supporting around the mouth to seal the container, wherein each of the first supporting protrusions is laterally formed with a hollow portion having a lower end cut; and a cover part having a hinge part formed integrally with and extending from the first supporting protrusions and then bent, and a plurality of second supporting protrusions at a lower end thereof to protrude inwardly therefrom, each of the plurality of second supporting protrusions being connected to a corresponding one of the plurality of first supporting protrusions through the hinge part, the cover part being positioned outside of the hermetically sealing holding part, wherein the second supporting protrusions are connected to one another through a band member, so as to prevent the stopper from being opened with the band member not broken, wherein the plurality of second supporting protrusions are formed integrally with the first supporting protrusions to protrude diametrically inwardly, wherein when the hermetically sealing upper end of the hermetically sealing holding part is pressed down and the cover part is simultaneously pulled upward at a plurality of ridges formed along an edge of the upper end of the cover part, the lower ends of the hermetically sealing holding part and the cover part connected through the hinge part are elastically deformed so that the first and second supporting protrusions are flared outwardly while pivoting outwardly, wherein the band member is constructed to be broken when the second supporting protrusions are expanded due to an external force and thus tension larger than a predetermined threshold is exerted on the band member.

2. A one touch-type container stopper, comprising:

a hermetically sealing holding part having a hermetically sealing upper end and a plurality of first supporting protrusions at a lower end thereof, the first supporting protrusions being formed to protrude inwardly such that they are elastically supported along an outer peripheral surface of a mouth of the container such that the hermetically sealing holding part is fitted hermetically due to the elastic supporting around the mouth to seal the container, wherein each of the first supporting protrusions is laterally formed with a hollow portion having a lower end cut; and a cover part having a hinge part formed integrally with and extending from the first supporting protrusions and then bent, and a second supporting protrusion at a lower end thereof to protrude inwardly therefrom, the supporting protrusion being connected to a corresponding one of the plurality of first supporting protrusions through the hinge part the cover part being positioned outside of the hermetically sealing holding part, wherein when the hermetically sealing upper end of the hermetically sealing holding part is pressed down and the cover part is simultaneously pulled upward at a plurality of ridges formed along an edge of the upper end of the cover part, the lower ends of the hermetically sealing holding part and the cover part connected through the hinge part are elastically deformed so that the first and second supporting protrusions are flared outwardly while pivoting outwardly, wherein the second supporting protrusion is formed integrally such that the stopper is opened in a one-touch matter.

3. The one touch-type container stopper as claimed in claim 1, wherein the height of the cover part is larger than that of the hermetically sealing holding part.

4. The one touch-type container stopper as claimed in claim 1, wherein the hermetically sealing holding part further comprises a first friction member on an outer surface, wherein the cover part further comprises a second friction member on an inner surface, and wherein the first friction member and the second friction member engage each other so as to be offset from each other while being elastically deformed.

5. The one touch-type container stopper as claimed in claim 1. wherein the hinge part has an inclination such that the hermetically sealing holding part side is at a level higher than that of the cover part side.

6. The one touch-type container stopper as claimed in claim 1, wherein a cover member is further provided at a lower end of the cover part to surround the second supporting protrusions.

7. A container, comprising:

a body portion of the container having a first catching projection at an upper end of a mouth thereof, and a second catching projection formed below the first catching projection, the second catching projection having an outer diameter larger than that of the first catching projection; and a stopper having a hermetically sealing holding part, a hermetically sealing upper end of which being fitted around the mouth to seal the container, and a cover part positioned outside of the hermetically sealing holding part, wherein the hermetically sealing holding part is provided with a plurality of first supporting protrusions at a lower end thereof to protrude inwardly such that they are caught and elastically supported by the first catching projection so as to make the hermetically sealing upper end of the hermetically sealing holding part seal the mouth of the container hermetically, wherein each of the first supporting protrusions is laterally formed with a hollow portion having a lower end cut, and the cover part is provided with a hinge part formed integrally with and extending from the first supporting protrusions and then bent, and a plurality of second supporting protrusions at a lower end thereof to protrude inwardly therefrom, each of the plurality of second supporting protrusions being connected to a corresponding one of the plurality of first supporting protrusions through the hinge part, the second supporting protrusions being connected to one another through a band member, so as to prevent the stopper from being opened with the band member not broken, wherein the plurality of second supporting protrusions are formed integrally with the first supporting protrusions to protrude diametrically inwardly, wherein when the hermetically sealing upper end of the hermetically sealing holding part is pressed down and the cover part is simultaneously pulled upward at a plurality of ridges formed along an edge of the upper end of the cover part, the lower ends of the hermetically sealing holding part and the cover part connected through the hinge part are elastically deformed so that the first and second supporting protrusions are flared outwardly while pivoting outwardly, wherein the band member is constructed to be broken when the second supporting protrusions are expanded due to an external force and thus tension larger than a predetermined threshold is exerted on the band member.

8. A container, comprising:

a body portion of the container having a first catching projection at an upper end of a mouth thereof, and a second catching projection formed below the first catching projection, the second catching projection having an outer diameter larger than that of the first catching projection; and a stopper having a hermetically sealing holding part, a hermetically sealing upper end of which being fitted around the mouth to seal the container, and a cover part positioned outside of the hermetically sealing holding part, wherein the hermetically sealing holding part is provided with a plurality of first supporting protrusions at a lower end thereof to protrude inwardly such that they are caught and elastically supported by the first catching projection so as to make the hermetically sealing upper end of the hermetically sealing holding part seal the mouth of the container hermetically, wherein each of the first supporting protrusions is laterally formed with a hollow portion having a lower end cut, and the cover part is provided with a hinge part formed integrally with and extending from the first supporting protrusions and then bent, and a second supporting protrusion at a lower end thereof to protrude inwardly therefrom, the second supporting protrusions being connected to a corresponding one of the plurality of first supporting protrusions through the hinge part, wherein when the hermetically sealing upper end of the hermetically sealing holding part is pressed down and the cover part is simultaneously pulled upward at a plurality of ridges formed along an edge of the upper end of the cover part, the lower ends of the hermetically sealing holding part and the cover part connected through the hinge part are elastically deformed so that the first and second supporting protrusions are flared outwardly while pivoting outwardly, wherein the second supporting protrusion is formed integrally such that the stopper is opened in a one-touch matter.

9. The container as claimed in claim 7, wherein a hermetically sealing member is further provided between the mouth of the body portion of the container and the hermetically sealing upper end of the hermetically sealing holding part.

* * * * *